US007875134B2

(12) United States Patent
Kim et al.

(10) Patent No.: US 7,875,134 B2
(45) Date of Patent: Jan. 25, 2011

(54) FE-BASED ALLOY HAVING CORROSION RESISTANCE AND ABRASION RESISTANCE AND PREPARATION METHOD THEREOF

(75) Inventors: Seon Jin Kim, Seoul (KR); Gyung Guk Kim, Gyeonggi-do (KR); Ji Hui Kim, Seoul (KR); Ki Nam Kim, Gyeonggi-do (KR); Ji Young Kim, Gangwon-do (KR)

(73) Assignee: IUCF-HYU (Industry-University Cooperation Foundation Hanyang University), Seoul (KR)

( * ) Notice: Subject to any disclaimer, the term of this patent is extended or adjusted under 35 U.S.C. 154(b) by 279 days.

(21) Appl. No.: 11/922,249

(22) PCT Filed: Nov. 12, 2007

(86) PCT No.: PCT/KR2007/005673

§ 371 (c)(1),
(2), (4) Date: May 29, 2008

(87) PCT Pub. No.: WO2008/111717

PCT Pub. Date: Sep. 18, 2008

(65) Prior Publication Data

US 2010/0021337 A1 Jan. 28, 2010

(30) Foreign Application Priority Data

Mar. 12, 2007 (KR) ..... 10-2007-0023962

(51) Int. Cl.

| | |
|---|---|
| ***C21D 5/00*** | (2006.01) |
| *C21D 6/00* | (2006.01) |
| *C22F 1/00* | (2006.01) |
| *A01H 5/02* | (2006.01) |
| *C22C 38/16* | (2006.01) |

(52) U.S. Cl. ..... 148/512; 148/538; 164/47; 420/62

(58) Field of Classification Search ..... 148/512, 148/538; 164/47; 420/62
See application file for complete search history.

(56) References Cited

FOREIGN PATENT DOCUMENTS

WO WO0007759 * 2/2000

* cited by examiner

*Primary Examiner*—Jessica L Ward
*Assistant Examiner*—Alexander Polyansky
(74) *Attorney, Agent, or Firm*—Christie, Parker & Hale, LLP

(57) ABSTRACT

A corrosion and wear resistant iron (Fe)-based alloy is provided. The Fe-based alloy consists essentially of 14.1 to 14.7% by weight of chromium (Cr), 1.41 to 1.47% by weight of carbon (C), 1.78 to 5.46% by weight of titanium (Ti), 0.11 to 0.39% by weight of aluminum (Al), 0.07 to 0.27% by weight of vanadium (V) and the balance of iron (Fe). The Fe-based alloy is highly resistant to corrosion and wear. In addition, since the Fe-based alloy is prepared using titanium alloy scrap at reduced cost, it is economically advantageous. Furthermore, the Fe-based alloy is environmentally friendly in terms of resource recycling. Further provided is a method for preparing the Fe-based alloy.

3 Claims, 3 Drawing Sheets

FE-BASED ALLOY HAVING CORROSION RESISTANCE AND ABRASION RESISTANCE AND PREPARATION METHOD THEREOF

CROSS-REFERENCE TO RELATED APPLICATION

This application is a National Phase Patent Application of International Application Number PCT/KR2007/005673, filed on Nov. 12, 2007, which claims priority of Korean Patent Application Number 10-2007-0023962, filed on Mar. 12, 2007.

TECHNICAL FIELD

The present invention relates to a corrosion and wear resistant iron (Fe)-based alloy and a method for preparing the Fe-based alloy. More specifically, the present invention relates to a Fe-based alloy that is highly resistant to corrosion and wear, economically advantageous and environmentally friendly, and a method for preparing the Fe-based alloy.

BACKGROUND ART

Corrosion and wear resistant Fe-based alloys are used for the production of wear-susceptible pieces and parts of mechanical elements. Particularly, corrosion and wear resistant Fe-based alloys are widely used as liner materials in various industrial applications, including steel foundries, mines and quarries. Other applications of corrosion and wear resistant Fe-based alloys are seawater pumps, impellers, and drums for automotive vehicles.

At present, martensitic steel and high-chromium high-carbon steel having undergone annealing are exclusively used as corrosion and wear resistant materials.

Martensitic steel has relatively high corrosion resistance due to its low carbon content but suffers from poor wear resistance. In contrast, high-chromium high-carbon steel is highly wear resistant due to the formation of chromium carbides but suffers from poor corrosion resistance.

Under such circumstances, extensive research has been conducted to solve the disadvantages of the conventional corrosion and wear resistant Fe-based alloys. For example, methods have been developed in which expensive addition elements, e.g., molybdenum (Mo), tantalum (Ta), zirconium (Zr), tungsten (W), titanium (Ti), nickel (Ni) and copper (Cu), are blended and alloyed with iron (Fe) to prepare a high-hardness Fe-based alloy. Other methods have been developed in which a hard alloy, tungsten (W), a carbide or an oxide is adhered to a binder, e.g., iron (Fe) or nickel (Ni), as a base metal to prepare an Fe-based alloy.

An Fe-based alloy composed of iron (Fe) as a base metal and large amounts of alloying elements, e.g., molybdenum (Mo), zirconium (Zr) and tungsten (W), has improved corrosion and wear resistance but is disadvantageous in terms of preparation cost due to the use of the expensive addition elements. Further, an Fe-based alloy composed of a hard material and a high-toughness metal adhered to the hard material has improved corrosion and wear resistance but is difficult to prepare, thus inevitably causing an increase in preparation cost.

Thus, there is a need to develop a material that is prepared at low cost and is highly resistant to corrosion and wear.

Titanium alloys whose surface is covered (i.e. passivated) with an oxide film are highly resistant to corrosion when compared to other metal materials. Titanium alloys have attracted attention as biologically compatible materials because no damage resulting from stress corrosion cracking, which is a drawback of stainless steel, substantially occurs. For example, Ti-6Al-4V alloys are mainly used as biologically compatible materials for the fixation of bone fractures and biologically compatible prosthetic materials for artificial bones and artificial joints in orthopedic applications.

Since titanium is much more expensive (about 0.5-1 million Korean Won per kg) than iron (about 1,000 Korean Won per kg), the preparation of titanium alloys incurs a considerable cost. Nevertheless, high-priced titanium alloy scrap is wasted without being recycled after the production of biologically compatible materials due to the absence of its industrial use in Korea and is currently exported at a low price.

Thus, there is a need for an approach aimed at recycling titanium alloy scrap from the viewpoint of economical efficiency and environmental protection.

DISCLOSURE

Technical Problem

The present invention has been made in an effort to solve the above problems, and it is a first object of the present invention to provide an Fe-based alloy that recycles titanium alloy scrap to achieve excellent resistance to corrosion and wear, reduced preparation cost (i.e. high economic efficiency) and environmental friendliness.

It is a second object of the present invention to provide a method for preparing the Fe-based alloy.

Technical Solution

In order to accomplish the first object of the present invention, there is provided a corrosion and wear resistant iron (Fe)-based alloy consisting essentially of 14.1 to 14.7% by weight of chromium (Cr), 1.41 to 1.47% by weight of carbon (C), 1.78 to 5.46% by weight of titanium (Ti), 0.11 to 0.39% by weight of aluminum (Al), 0.07 to 0.27% by weight of vanadium (V) and the balance of iron (Fe).

The metals Ti, Al and V are preferably present in a weight ratio of 89-91:5.5-6.5:3.5-4.5.

In order to accomplish the second object of the present invention, there is provided a method for preparing a corrosion and wear resistant iron (Fe)-based alloy, the method comprising the steps of:

(a) weighing 94 to 98% by weight of an Fe—Cr—C alloy and 2 to 6% by weight of a Ti—Al—V alloy as raw material, the raw material consisting essentially of 14.1 to 14.7% by weight of chromium (Cr), 1.41 to 1.47% by weight of carbon (C), 1.78 to 5.46% by weight of titanium (Ti), 0.11 to 0.39% by weight of aluminum (Al), 0.07 to 0.27% by weight of vanadium (V) and the balance of iron (Fe);

(b) melting the raw material at 1,600 to 1,800° C.;

(c) tapping the molten metal at 1,500 to 1,600° C.; and (d) pouring the molten metal into a mold and casting the molten metal.

The weight ratio between Ti, Al and V in the Ti, Al and V alloy is preferably 89-91:5.5-6.5:3.5-4.5.

Advantageous Effects

The Fe-based alloy of the present invention is highly resistant to corrosion and wear. In addition, since the Fe-based alloy of the present invention is prepared using titanium alloy scrap at reduced cost, it is economically advantageous. Furthermore, the Fe-based alloy of the present invention is environmentally friendly in terms of resource recycling.

BEST MODE

Figure 1:
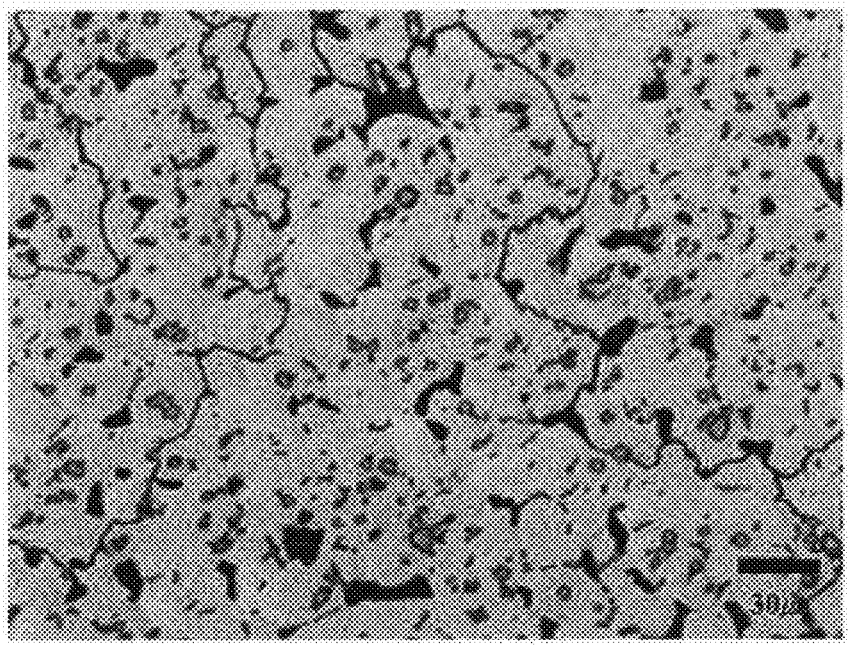
FIG. 1 is an optical microscopy image (200×) of the microstructure of Inventive Steel No. 1.

Exemplary embodiments of the present invention will now be described in greater detail.

The present invention provides an Fe-based alloy that is highly resistant to corrosion and wear and is prepared using titanium alloy scrap in an environmentally friendly manner at reduced cost without the addition of any expensive alloying elements to achieve improved resistance to corrosion and wear.

Percentages (%) used throughout the specification are by weight, unless otherwise specified.

Specifically, the Fe-based alloy of the present invention comprises 14.1 to 14.7% by weight of chromium (Cr), 1.41 to 1.47% by weight of carbon (C), 1.78 to 5.46% by weight of titanium (Ti), 0.11 to 0.39% by weight of aluminum (Al), 0.07 to 0.27% by weight of vanadium (V), and the balance of iron (Fe) and unavoidable impurities. The composition of the Fe-based alloy according to the present invention was determined in view of the following characteristics of the respective components. Chromium (Cr) reacts with carbon (C) to form chromium carbides (e.g., $Cr_7C_3$ and $Cr_xC_y$), which improve the hardness and wear resistance of the Fe-based alloy, and reacts with oxygen in air to form $Cr_2O_3$, which improves the corrosion resistance of the Fe-based alloy and enhances the strength of the matrix phase. The chromium content of the Fe-based alloy is appropriately determined in the range of 14.1 to 14.7% by weight. If the chromium content is less than 14.1% by weight, the corrosion resistance of the Fe-based alloy is impaired due to high carbon content. Meanwhile, if the chromium content is more than 14.7% by weight, the toughness of the Fe-based alloy is reduced and the processability and corrosion resistance of the Fe-based alloy are deteriorated due to the formation of δ-ferrite. Taking into consideration the improvement of resistance to wear and corrosion resulting from the presence of the carbides, the chromium content is limited to the range defined above.

Carbon (C) is solid-dissolved in the Fe matrix to enhance the strength of the Fe-based alloy and reacts with the other elements of the alloy to form hard carbides. In addition, carbon serves to stabilize the austenitic structure, and at the same time, to extend the zone of the austenitic structure, thus allowing for the addition of titanium (Ti), aluminum (Al), vanadium (V), etc. as elements for the improvement of the corrosion resistance of the Fe-based alloy. Moreover, carbon inhibits the formation of δ-ferrite. The carbon content of the Fe-based alloy is appropriately determined in the range of 1.41 to 1.47% by weight. The use of carbon in an amount of less than 1.41% by weight causes the formation of small amounts of carbides, resulting in a deterioration in the wear resistance of the Fe-based alloy. Meanwhile, the use of carbon in an amount greater than 1.47% by weight causes the deposition of large amounts of carbides, thus weakening the Fe-based alloy and deteriorating the toughness and corrosion resistance of the Fe-based alloy. Titanium (Ti) is bonded to carbon (C) to form granular carbides, thus contributing to an increase in hardness and an improvement in wear resistance. The carbides serve to improve the mechanical strength and wear resistance of the Fe-based alloy at high temperature because they are not readily solid-dissolved at high temperature. Titanium functions to prevent the formation of chromium carbides, which are reaction products of carbon (C) with chromium (Cr), to improve the toughness of the Fe-based alloy. In addition, titanium is an element that is effective in preventing the chromium (Cr) from being exhausted in the matrix. Taking into account the relationship with the carbon content, the titanium content of the Fe-based alloy is determined in the range of 1.78% to 5.46% by weight to improve the intergranular corrosion resistance of the Fe-based alloy. The use of titanium in an amount smaller than 1.78% by weight does not contribute to improvement of the intergranular corrosion resistance of the Fe-based alloy. Meanwhile, the use of titanium in an amount exceeding 5.46% by weight causes a drastic deterioration in the castability of a molten metal of the alloy and excessive oxidation of the molten metal, thereby making the workability complicated, and increases the preparation cost of the alloy without further improvement of the addition effect. That is, an excessive amount of titanium is economically inefficient.

Aluminum (Al), a source of aluminum oxide or aluminum nitride, serves to remove oxygen or nitrogen gas and provides sites where carbides are nucleated to promote the fineness of crystal grains. In addition, aluminum enhances the strength of the matrix phase and improves the impact absorption energy of the alloy. The aluminum content of the Fe-based alloy is appropriately determined in the range of 0.11% to 0.39% by weight. The use of aluminum in an amount smaller than 0.11% by weight produces few or no addition effects. Meanwhile, the use of aluminum in an amount exceeding 0.39% by weight causes a remarkable increase in the brittleness of the Fe-based alloy.

Vanadium (V) is a potent carbide-forming element that is capable of crystallizing carbides at high temperature. Vanadium (V) is combined with titanium (Ti) to form high-hardness carbides, thus improving the wear resistance of the Fe-based alloy. In addition, the addition of vanadium (V) and chromium (Cr) in a state in which the two elements coexist further stabilizes the passivation coating of the Fe-based alloy, improves the corrosion resistance of the Fe-based alloy in salt water, and enhances the high-temperature strength and creep resistance of the Fe-based alloy. The vanadium content of the Fe-based alloy is appropriately determined in the range of 0.07% to 0.27% by weight. The use of vanadium in an amount smaller than 0.07% by weight produces few or no addition effects. Meanwhile, the use of vanadium in an amount exceeding 0.27% by weight causes the problem that the toughness and stress corrosion cracking of the Fe-based alloy are considerably increased.

It is preferred to adjust the weight ratio of the metals Ti, Al and V to 89-91:5.5-6.5:3.5-4.5.

The composition of titanium, aluminum and vanadium in the Fe-based alloy is the same as that of Ti-6Al-4V, which is the most commercially available titanium alloy. Titanium and vanadium whose weight ratio is within the range defined above are bonded to carbon to form fine carbides, which prevent chromium from being exhausted in the matrix phase and markedly retard the corrosion of the Fe-based alloy to improve the corrosion resistance of the Fe-based alloy in seawater. In addition, the carbides are homogeneously distributed to improve the wear resistance of the Fe-based alloy.

The Fe-based alloy of the present invention has a weight loss as low as 200 mg, as measured in accordance with the American Society for Testing Materials (ASTM) G65 method, and a weight loss per unit area after dipping for 100 hours in artificial seawater as low as $0.02\times10^{-3}$ g/cm$^2$, as measured in accordance with the ASTM D1141 method.

These results indicate that the Fe-based alloy has excellent resistance to corrosion and wear.

The present invention also provides the Fe-based alloy having the composition defined above. A detailed explanation of the respective steps of the method according to the present invention will be given below.

(1) Weighing 94 to 98% by weight of an Fe—Cr—C alloy and 2 to 6% by weight of a Ti—Al—V alloy are weighed as raw material, the raw material consisting essentially of Cr: 14.1-14.7 wt %, C: 1.41-1.47 wt %, Ti: 1.78-5.46 wt %, Al: 0.11-0.39 wt %, V: 0.07-0.27 wt % and the balance of iron (Fe) and unavoidable impurities.

The Fe—Cr—C alloy is prepared by adding relatively cheap chromium and carbon as alloying elements to iron as a base metal. Various Fe—Cr—C alloys can be prepared by varying the amounts of the alloying elements. The use of Fe-15% Cr-1.5% C is preferred in terms of resistance to corrosion and wear.

The Ti—Al—V alloy is preferably Ti—Al—V alloy scrap. The Ti—Al—V alloy scrap is available at reduced cost, which is economically advantageous. In addition, the use of the alloy scrap is environmentally friendly in terms of resource recycling. Ti-6% Al-4% V alloy scrap is preferred taking into consideration the wear resistance and corrosion resistance of the final alloy.

If the content of the Fe-15% Cr-1.5% C alloy is less than 94% by weight, the corrosion resistance of the final alloy is deteriorated due to the relatively low chromium content. Further, the relatively high content of the Ti—Al—V alloy degrades the castability of the final alloy and increases the preparation cost of the final alloy. Meanwhile, when the content of the Fe-15% Cr-1.5% C alloy is more than 98% by weight (i.e. the Ti—Al—V alloy is relatively added in a relatively small amount), the effects of the Ti—Al—V alloy on the corrosion resistance and wear resistance of the final alloy are negligible. If the content of the Ti—Al—V alloy scrap is less than 2% by weight, the amount of carbides formed is reduced and the exhaustion of chromium in the matrix phase is ineffectively prevented, resulting in little improvement in the wear and corrosion resistance of the final alloy. Meanwhile, if the content of the Ti—Al—V alloy scrap exceeds 6% by weight (i.e., the titanium content is relatively high), the flowability of a molten metal is increased and the preparation cost of the final alloy is increased.

(2) Melting

The weighed raw material is melted. Any technique may be employed, without any particular limitation, to melt the raw material. The raw material may be melted in air or under vacuum. Specifically, 94 to 98% by weight of the Fe—Cr—C alloy and 2 to 6% by weight of the Ti—Al—V alloy scrap are charged into a high-frequency vacuum induction furnace. After the internal pressure of the furnace is decreased to $3.0\text{-}4.0\times10^{-1}$ torr, argon gas is fed into the furnace until the pressure reaches 60-80 torr. The raw material are melted at a temperature of 1,600-1,800° C. with a high-frequency output of 45-50 A.

The raw material is not readily melted below 1,600° C. and are excessively evaporated or seriously oxidized above 1,800° C., making it difficult to control the composition of the final alloy.

(3) Tapping

After completion of the melting, the molten metal is tapped from the furnace. Specifically, the solidification temperature of the raw material is measured using a solidification temperature tester, and then the molten metal is tapped using a ladle at a temperature by 100-200° C. higher than the solidification temperature. When the molten metal is tapped at a temperature below 1,500° C., the flowability of the molten metal is reduced, and as a result, solidification begins to take place from the surface of the molten metal before pouring into a mold. Meanwhile, when the molten metal is tapped at a temperature above 1,600° C., the molten alloys may be oxidized and evaporated, making it difficult to control the composition of the final alloy.

(4) Casting

The molten metal is poured into a mold at an appropriate temperature and is cast to prepare the final Fe-based alloy. The pouring is preferably conducted at a temperature by 100-200° C. higher than the liquidus temperature of the molten metal. The liquidus temperature can be measured using a solidification temperature tester equipped with a thermocouple.

The Fe-based alloy thus prepared has a weight loss as low as 200 mg, as measured in accordance with the ASTM G65 method, and a weight loss per unit area after dipping for 100 hours in an artificial seawater solution as low as $0.02\times10^{-3}$ g/cm$^2$, as measured in accordance with the ASTM D1141 method, indicating that the Fe-based alloy has excellent resistance to corrosion and wear. Therefore, the Fe-based alloy of the present invention is very suitable for use in mining supplies of mineral and ore mining equipment, seawater pumps, impellers, etc. requiring excellent resistance to corrosion and wear.

MODE FOR INVENTION

Hereinafter, the present invention will be explained in more detail with reference to the following examples. However, these examples are given for the purpose of illustration only and are not intended to limit the present invention.

EXAMPLES

Example 1

965 g of Fe-15% Cr-1.5% C and 35 g of Ti-6% Al-4% V were charged into a high-frequency vacuum induction furnace. After the internal pressure of the furnace was reduced to $3.0\times10^{-1}$ torr, argon gas was fed into the furnace until the pressure reached 60 torr. The alloys were melted at 1,700° C. The solidification temperature of the alloys was measured using a solidification temperature tester equipped with a thermocouple. The molten metal was tapped from the furnace at 1,500° C. The molten metal was poured into a high-frequency vacuum induction furnace (STI, Daegu City, Korea) at 1,600° C., followed by cooling to prepare steel of the present invention ('Inventive Steel No. 1').

Comparative Examples 1, 2, 3 and 4

Fe-15% Cr-1.5% C ('Comparative Steel No. 1'), Fe-15% Cr-0.68% martensitic steel ('Comparative Steel No. 2'), high-chromium high-carbon steel ('Comparative Steel No. 3') and Fe-20% Cr-1.7% C-1% Si ('Comparative Steel No. 4') were prepared. The chemical compositions of Inventive Steel No. 1 and Comparative Steel Nos. 1-4 are summarized in Table 1.

TABLE 1

| Steel No. | Composition (wt %) Cr | C | Ti | Al | V | Mo | Ni | W | Si | Remarks |
|---|---|---|---|---|---|---|---|---|---|---|
| Inventive Steel 1 | 14.5 | 1.44 | 2.97 | 0.19 | 0.12 | — | — | — | — | |
| Comparative Steel 1 | 15 | 1.5 | — | — | — | — | — | — | — | Fe—15%Cr—1.5%C |
| Comparative Steel 2 | 15 | 0.68 | — | — | — | — | — | — | — | Martensitic steel (Fe—15%Cr—0.68%C) |
| Comparative Steel 3 | 30 | 2 | — | — | — | 6 | 5 | 6 | — | High-Cr high-C steel |
| Comparative Steel 4 | 20 | 1.7 | — | — | — | — | — | — | 1 | Fe—20%Cr—1.7%C—1%Si |

TEST EXAMPLES

Test Example 1

Observation of Microstructure by Optical Microscopy

Inventive Steel No. 1 was electro-etched at a voltage of 5 V for 5 seconds in a solution of chromium oxide (10 g) in 100 ml of distilled water. The microstructure of Inventive Steel No. 1 was observed using an optical microscope.

Figure 2:
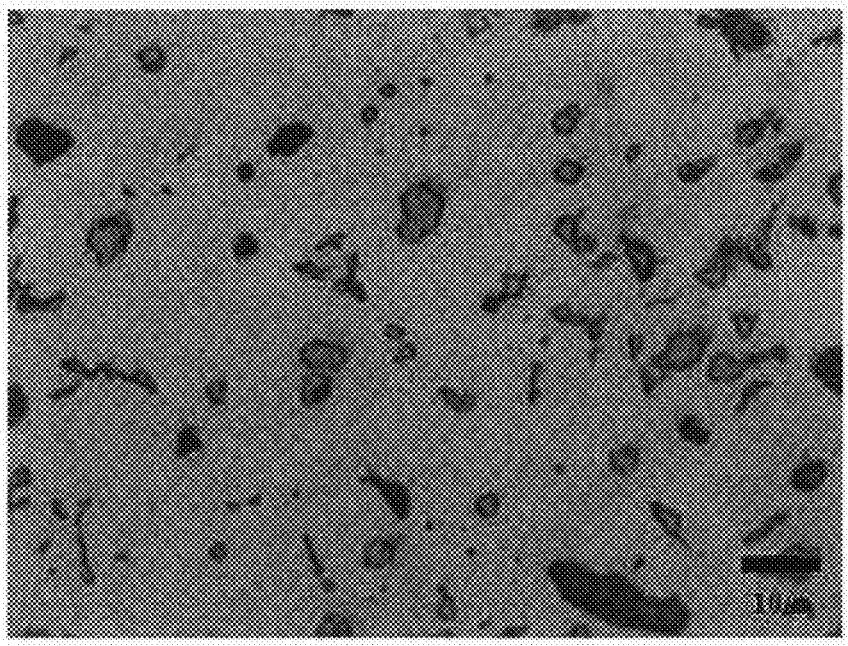
FIG. 2 is an optical microscopy image (500×) of the microstructure of Inventive Steel No. 1.

FIGS. 1 and 2 are optical microscopy images of the microstructure of Inventive Steel No. 1 at magnifications of 200× and 500×, respectively.

The images of FIGS. 1 and 2 demonstrate that Inventive Steel No. 1, a corrosion and wear resistant Fe-based alloy of the present invention, had a microstructure in which fine deposits were homogeneously dispersed in an austenitic matrix.

Test Example 2

Analysis of Phase Using X-Ray Diffractometer and Ferritescope

Figure 3:
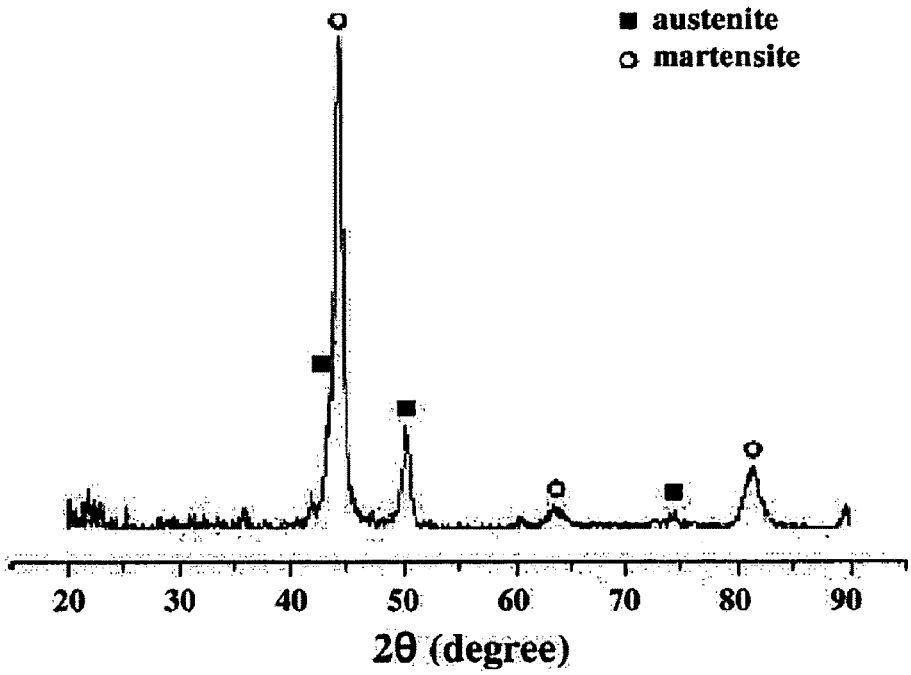
FIG. 3 is a graph showing phase analysis results for Inventive Steel No. 1 by X-ray diffractometry (XRD).

FIG. 3 is a graph showing phase analysis results for Inventive Steel No. 1 by X-ray diffractometry (XRD).

The graph of FIG. 3 reveals that Inventive Steel No. 1 was composed of austenite and martensite phases.

For more accurate analysis, a ferritescope based on magnetization was used to measure the fractions of the austenite and martensite phases in Inventive Steel No. 1. The fractions of the martensite phase in Inventive Steel No. 1 are shown in Table 2.

TABLE 2

| Cycle | 1 | 2 | 3 | 4 | 5 | 6 | 7 | 8 | 9 | 10 | Ave. | S.D. |
|---|---|---|---|---|---|---|---|---|---|---|---|---|
| Fraction | 2.78 | 5.21 | 10.46 | 6.42 | 14.61 | 1.75 | 8.34 | 6.59 | 11.73 | 5.94 | 7.49 | 3.97 |

The results of Table 2 show that most of the fractions of the martensite phase in Inventive Steel No. 1 were less than 10%, indicating that the fraction of the austenite phase in Inventive Steel No. 1 was more than 90%. In conclusion, the main phase of Inventive Steel No. 1 was austenite.

Test Example 3

Identification of Wear Resistance by Abrasive Wear Testing

Each of Inventive Steel No. 1 and Comparative Steel Nos. 1, 2 and 3 was tested for weight loss by abrasive wear testing in accordance with the ASTM G65 method. The results are shown in FIG. 4.

Figure 4:
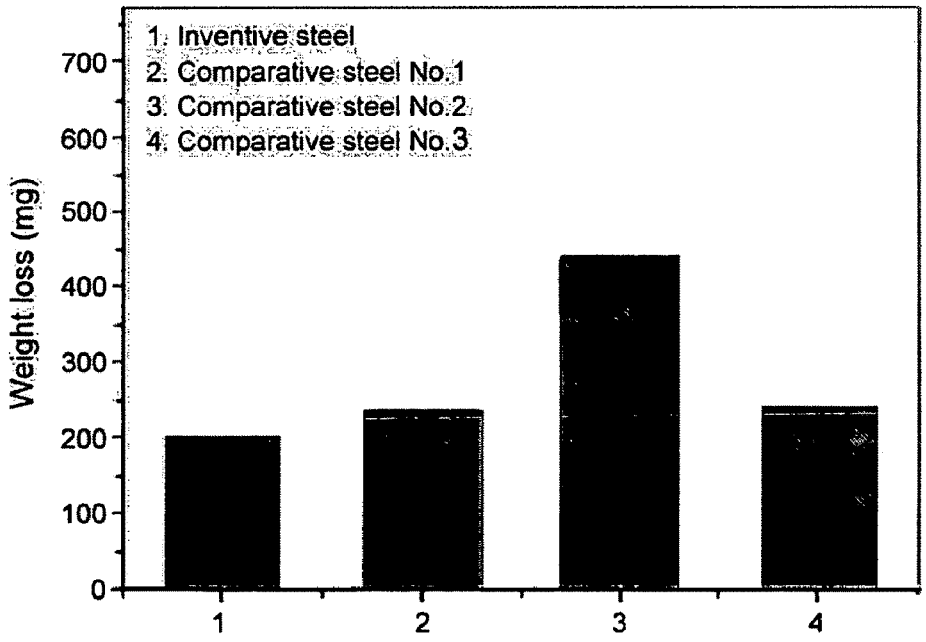
FIG. 4 is a graph showing the results of weight loss of Inventive Steel No. 1 and Comparative Steel Nos. 1, 2 and 3 after abrasive wear testing in accordance with the ASTM G65 method.

From the graph of FIG. 4, it was confirmed that the martensitic steel (Comparative Steel No. 2) showed very poor wear resistance whereas Inventive Steel No. 1 showed superior wear resistance over Comparative Steel No. 1 and the high-chromium high-carbon steel (Comparative Steel No. 3) containing expensive alloying elements.

Test Example 4

Identification of Corrosion Resistance by Dipping Test in Artificial Seawater Solution Each of Inventive Steel No. 1 and Comparative Steel Nos. 1, 2, 3 and 4 was tested for weight loss per unit area after dipping in an artificial seawater solution as a corrosive environment in accordance with the ASTM D1141 method. Each test was conducted for 25, 50 and 100 hours. The results are shown in FIG. 5.

Figure 5:
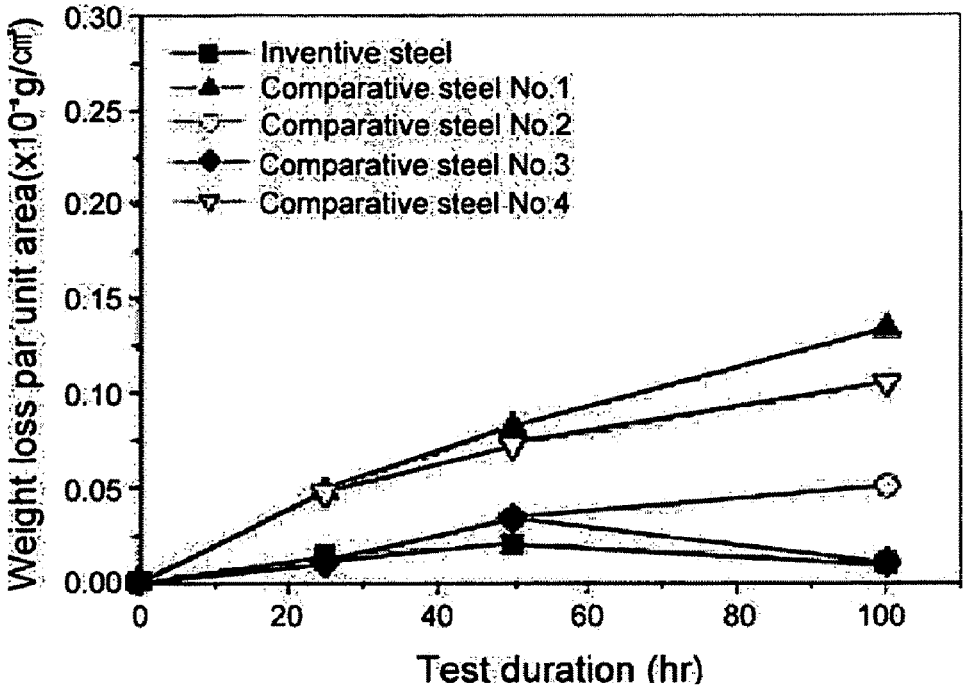
FIG. 5 is a graph showing the results of weight loss per unit area of Inventive Steel No. 1 and Comparative Steel Nos. 1, 2, 3 and 4 after dipping in an artificial seawater solution in accordance with the ASTM D1141 method.

The graph of FIG. 5 shows that 100 hours after dipping in the artificial seawater solution, the weight loss of Inventive Steel No. 1 resulting from corrosion was greatly lowered when compared to that of the martensitic steel (Comparative Steel No. 2). In addition, no rust was found in Inventive Steel No. 1. Although the weight loss of Inventive Steel No. 1 after dipping for 100 hours was comparable to that of the high-chromium high-carbon steel (Comparative Steel No. 3) containing expensive alloying elements, Inventive Steel No. 1 is economically advantageous in terms of wear resistance over Comparative Steel No. 3.

The invention claimed is:

1. A method for preparing a corrosion and wear resistant iron (Fe)-based alloy, the method comprising the steps of:

(a) weighing 94 to 98% by weight of an Fe—Cr—C alloy and 2 to 6% by weight of a Ti—Al—V alloy as raw material, the raw material consisting essentially of 14.1 to 14.7% by weight of chromium (Cr), 1.41 to 1.47% by weight of carbon (C), 1.78 to 5.46% by weight of titanium (Ti), 0.11 to 0.39% by weight of aluminum (Al), 0.07 to 0.27% by weight of vanadium (V) and the balance of iron (Fe);

(b) melting the raw material at 1,600 to 1,800° C.;

(c) tapping the molten metal at 1,500 to 1,600° C.; and (d) pouring the molten metal into a mold and casting the molten metal.

2. The method according to claim 1, wherein the Fe—Cr—C alloy is an Fe-15% Cr-1.5% C alloy.

3. The method according to claim 1, wherein the Ti—Al—V alloy is Ti-6% Al-4% V alloy scrap.

* * * * *